US007402146B2

(12) United States Patent
Wu

(10) Patent No.: US 7,402,146 B2
(45) Date of Patent: Jul. 22, 2008

(54) FURNITURE WITH AN INFLATABLE BODY AND VIBRATOR

(76) Inventor: Hsin-Tsai Wu, 1F, No. 19, Alley 3, Lane 106, Sec. 3, Min-Chaun E. Rd., Taipei City (TW)

( * ) Notice: Subject to any disclaimer, the term of this patent is extended or adjusted under 35 U.S.C. 154(b) by 343 days.

(21) Appl. No.: 11/198,249

(22) Filed: Aug. 5, 2005

(65) Prior Publication Data

US 2007/0032752 A1 Feb. 8, 2007

(51) Int. Cl.
*A61H 1/00* (2006.01)
*A61H 23/02* (2006.01)

(52) U.S. Cl. ..... 601/56; 601/58; 5/915

(58) Field of Classification Search ..... 601/46, 601/49, 56, 57, 58, 59, 60, 61, 65, 66, 70, 601/78; 5/915

See application file for complete search history.

(56) References Cited

U.S. PATENT DOCUMENTS

| | | | | |
|---|---|---|---|---|
| 5,361,437 | A * | 11/1994 | Zhu et al. | 5/639 |
| 5,951,500 | A * | 9/1999 | Cutler | 601/47 |
| 6,682,494 | B1 * | 1/2004 | Sleichter et al. | 601/57 |
| 6,695,798 | B2 * | 2/2004 | Chang | 601/49 |
| 2003/0028132 | A1 * | 2/2003 | Bastia et al. | 601/57 |
| 2004/0143201 | A1 * | 7/2004 | Moriyasu | 601/57 |
| 2004/0193078 | A1 * | 9/2004 | Flick et al. | 601/58 |
| 2005/0015027 | A1 * | 1/2005 | Kojima | 601/57 |
| 2006/0058713 | A1 * | 3/2006 | Lee | 601/57 |

* cited by examiner

*Primary Examiner*—Danton DeMille

(57) ABSTRACT

A furniture includes an inflatable body and a plurality of vibrating units. Each of the vibrating units is mounted on the inflatable body, and includes a vibrating plate that is spaced apart from the inflatable body and that is formed with protrusions thereon, and a driving member for driving vibration of the vibrating plate.

3 Claims, 5 Drawing Sheets

FURNITURE WITH AN INFLATABLE BODY AND VIBRATOR

BACKGROUND OF THE INVENTION

1. Field of the Invention

The invention relates to a furniture, more particularly to a furniture with an inflatable body and a plurality of vibrating units.

2. Description of the Related Art

Inflatable mattresses or sofas are convenient to store and transport when not in use. However, conventional inflatable mattresses or sofas only provide basic functionalities for sleep and rest, and are unable to provide functionalities such as massaging, etc.

SUMMARY OF THE INVENTION

Therefore, the object of the present invention is to provide a furniture with an inflatable body that is capable of providing massaging functionality.

According to this invention, there is provided a furniture that comprises an inflatable body and a plurality of vibrating units. Each of the vibrating units is mounted on the inflatable body, and includes a vibrating plate that is spaced apart from the inflatable body and that is formed with protrusions thereon, and a driving member for driving vibration of the vibrating plate.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
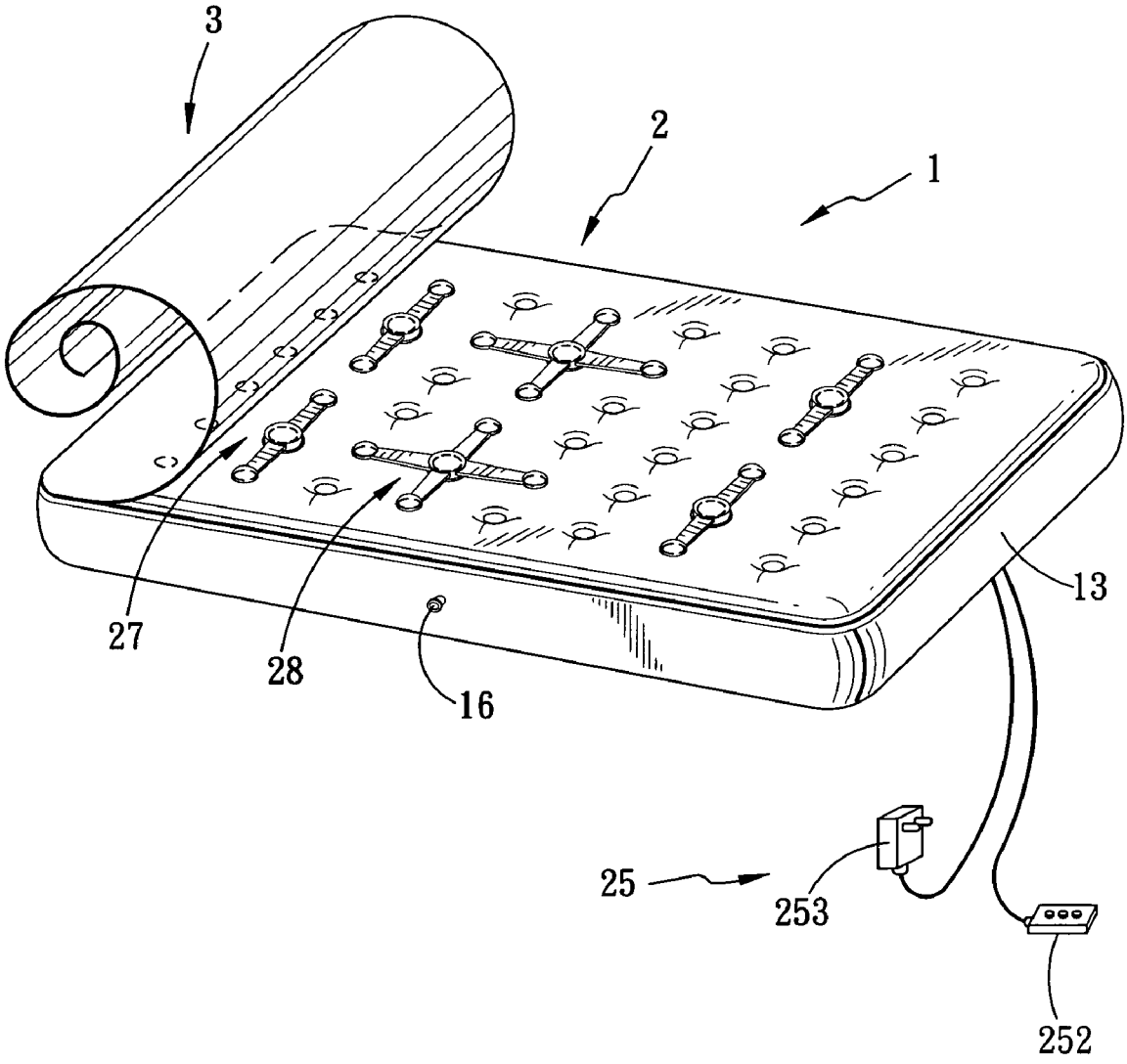
FIG. 1 is a perspective view of the first preferred embodiment of a furniture with an inflatable body according to the present invention.

Before the present invention is described pad in greater detail with reference to the accompanying preferred embodiments, it should be noted herein that like elements are denoted by the same reference numerals throughout the disclosure.

Figure 2:
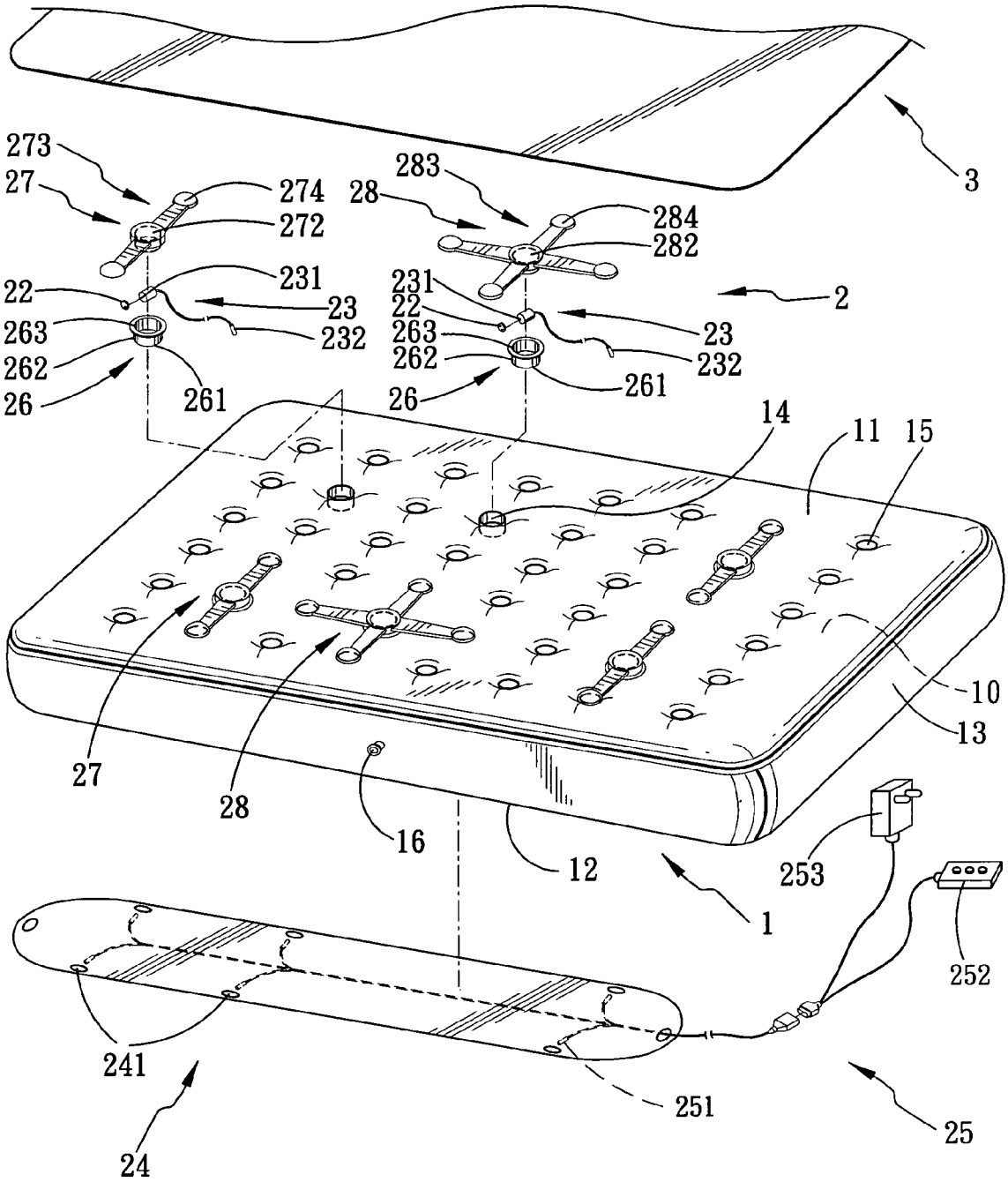
FIG. 2 is an exploded perspective view of the first preferred embodiment.

Referring to FIGS. 1 and 2, the first preferred embodiment of a furniture according to the present invention is shown to include an inflatable body 1, a plurality of vibrating units 2, and a cover sheet 3. In this embodiment, the inflatable body 1 is an inflatable mattress, and is made from a plastic material.

The inflatable body 1 includes a generally rectangular upper wall 11, a generally rectangular lower wall 12, and a peripheral wall 13 connected sealingly to edges of the upper and lower walls 11, 12 using high-frequency welding techniques. The peripheral wall 13 and the upper and lower walls

11, 12 cooperate to define an inner space 10 for receiving injected air therein. The inflatable body 1 is formed with a plurality of channels 14, each of which extends through the inner space 10 and the upper and lower walls 11, 12, and each of which is defined by a flexible channel-defining wall 141 (see FIG. 4). The inflatable body 1 further includes an air valve 16 mounted on one side of the peripheral wall 13. Each of the channel-defining walls 141 is formed by welding a tension member 15, which is columnar in shape and which is made from the aforesaid plastic material, to the upper and lower walls 11, 12 by high-frequency welding techniques. The tension members 15 (i.e., the channel-defining walls 141) are used to maintain the distance between the upper and lower walls 11, 12 when the inflatable body 1 is inflated.

Figure 3:
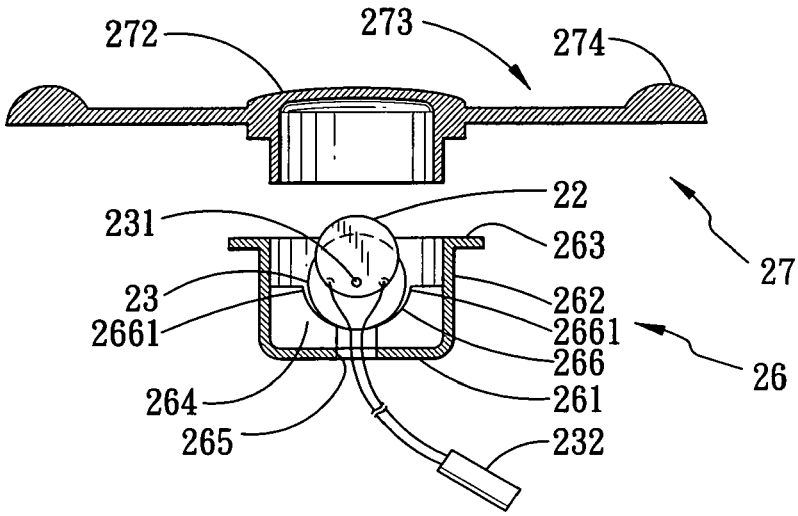
FIG. 3 is a partly disassembled, schematic sectional view of a vibrating unit of the first preferred embodiment.
Figure 4:
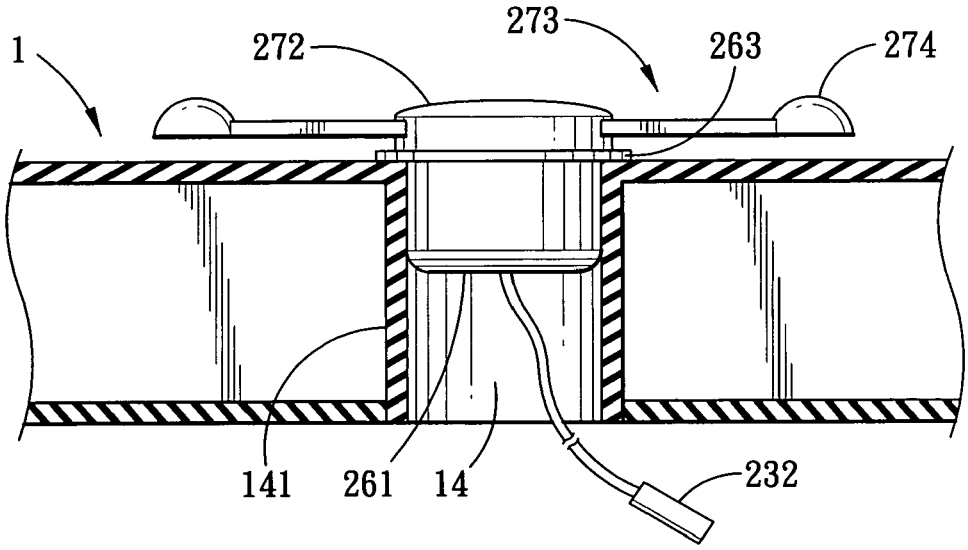
FIG. 4 is an assembled partly sectional view of the vibrating unit of the first preferred embodiment.

Referring to FIGS. 2 to 4, each of the vibrating units 2 is mounted on the inflatable body 1, and includes a vibrating plate 27, 28, an inverted cap 26, and a driving member 23. The inverted cap 26 is fittingly mounted in a respective one of the channels 14, and includes a bottom wall 261, a peripheral wall 262 extending upwardly from a periphery of the bottom wall 261, and a flange 263 extending radially and outwardly from a top edge of the peripheral wall 262 for anchoring on the upper wall 11 of the inflatable body 1.

The driving member 23 is mounted in the inverted cap 26 for driving vibration of the inverted cap 26, and includes a motor with an output shaft 231, a circular driving plate 22 eccentrically connected to the output shaft 231, and a first plug terminal 232 connected to the motor.

The vibrating plate 27, 28 is spaced apart from the inflatable body 1, and has a cap portion 272, 282 abutting against the flange 263 of the inverted cap 26 and registered with the bottom wall 261 of the inverted cap 26 for covering the inverted cap 26.

There are two types of the vibrating plates 27, 28 in this embodiment. The first type of the vibrating plates 27 is linear in shape, and has a pair of opposite resilient arms 273 extending from the cap portion 272. The second type of the vibrating plates 28 is cross-shaped, and has two pairs of opposite resilient arms 283 extending from the cap portion 282 and transverse to each other. The free end of each resilient arm 273, 283 is formed with a semi-circular protrusion 274, 284 thereon. It is noted that the protrusions 274, 284 are kept at an appropriate distance from the upper wall 11 of the inflatable body 1 so as to minimize undesired noise attributed to resonance within the inner space 10 of the inflatable body 1 during vibration of the resilient arms 273, 283. The cap portion 272, 283 of the vibrating plate 27, 28 is inserted fittingly into the peripheral wall 262 of the inverted cap 26 so as to be vibrated together with the inverted cap 26 upon actuation of the driving member 23.

Referring to FIG. 3, each of the vibrating units 2 further includes an engaging member 264 that is formed in the inverted cap 26 and that has a curved recessed surface 266 around the driving plate 22., The engaging member 264 has a bottom portion formed with a through-hole 265 for extension of the first plug terminal 232 therethrough. The recessed surface 266 has two end portions 2661, and the driving plate 22 contacts alternately the end portions 2661 of the recessed surface 266 when rotated eccentrically by the output shaft 231 of the motor, thereby enabling swinging of the vibrating plate 27, 28 together with the inverted cap 26.

The cover sheet 3 is made from a flexible material, and is placed on the inflatable body 1 to cover the vibrating units 2 and to provide a comfortable contact layer for the user during use.

The furniture further includes an insulative protection sleeve 24 attached to a bottom side of the lower wall 12, and a power supply unit 25 coupled electrically to the insulative protection sleeve 24. The insulative protection sleeve 24 is formed with a plurality of plug holes 241 spaced apart from each other. The power supply unit 25 includes a controller 252, a power supply 253 connected to the controller 252, and a plurality of second plug terminals 251 coupled to the controller 252 and the power supply 253 and disposed in the insulative protection sleeve 24 for electrical coupling with corresponding ones of the first plug terminals 232 through the plug holes 242. The power supply 253 is connected electrically to an external power source (not shown) so as to provide electric power to the driving members 23.

In use, the user lies down on the cover sheet 3, and activates the vibrating units 2 through a power switch of the controller 252. Preferably, the frequency of vibration can be adjusted through the controller 252. When the output shaft 231 of the driving member 23 rotates, the driving plate 22 rotates accordingly. Since the driving plate 23 is eccentrically connected to the output shaft 231, the driving plate 23 engages and disengages the engaging portion 2661 of the recesses surface 266 of the engaging member 264 alternately so that the inverted cap 26 and the vibrating plate 27, 28 vibrate accordingly, thereby resulting in a massaging effect on the user's body through the protrusions 274, 284.

It should be noted herein that the layout and selection of the type of vibrating plates 27, 28 are flexible. In this embodiment, the first and second types of vibrating plates 27, 28 are disposed alternately. Alternatively, only one type of the vibrating plates 27, 28 may be in use.

Figure 5:
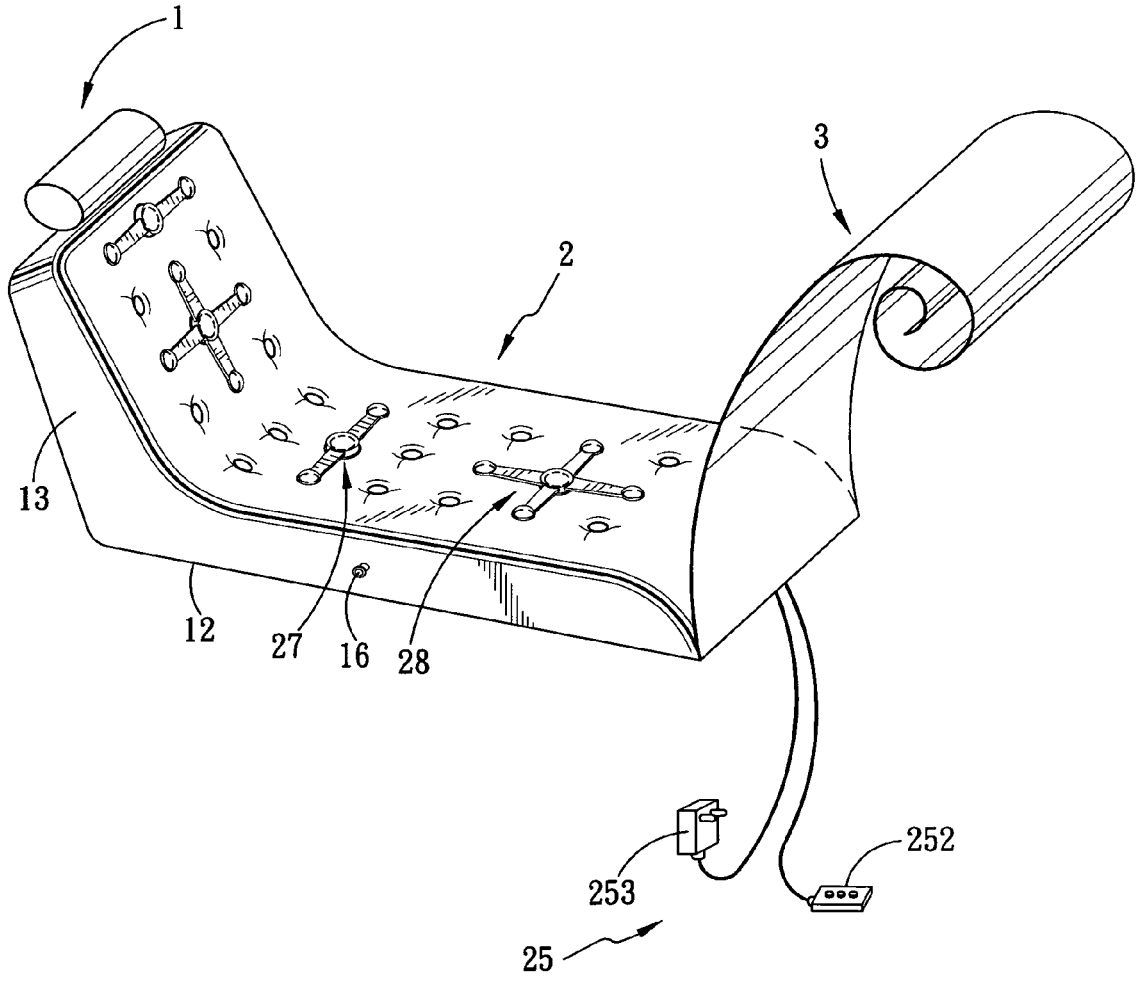
FIG. 5 is a perspective view of the second preferred embodiment of a furniture with an inflatable body according to the present invention.
Figure 6:
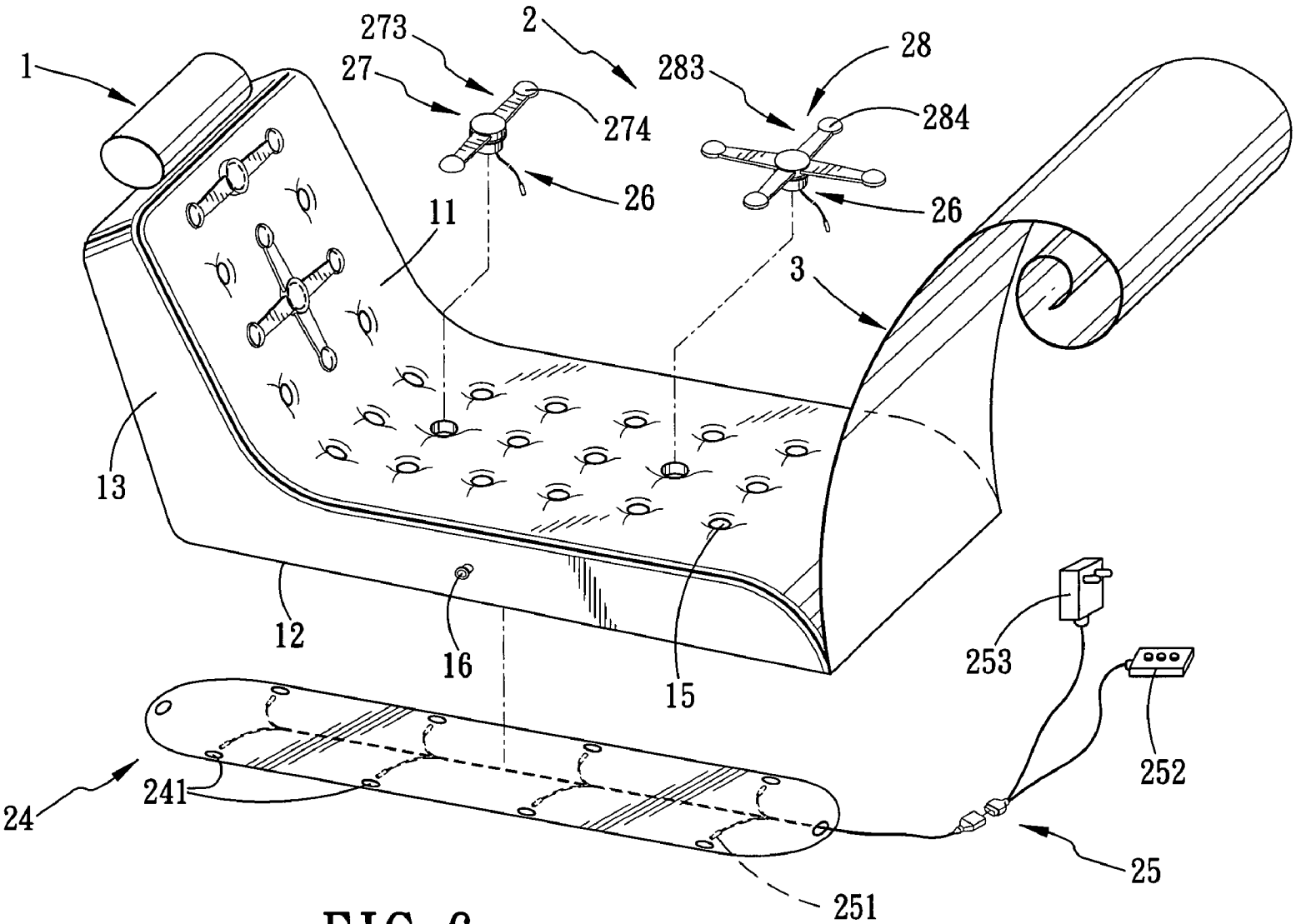
FIG. 6 is an exploded perspective view of the second preferred embodiment.

Referring to FIGS. 5 and 6, the second preferred embodiment of this invention differs from the first preferred embodiment in that the inflatable body 1 of the second preferred embodiment is an inflatable sofa.

With the inclusion of the vibrating units 2 in the furniture of this invention, the furniture can provide massaging functionality that is not provided in the aforesaid conventional furniture.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A furniture comprising:

an inflatable body; and a plurality of vibrating units, each of which is mounted on said inflatable body and each of which includes a vibrating plate that is spaced apart from said inflatable body and that is formed with protrusions thereon, and a driving member for driving vibration of said vibrating plate;

wherein said inflatable body defines an inner space therein, has opposite flexible upper and lower walls, and is formed with a plurality of channels, each of which extends through said inner space and said upper and lower walls and each of which is defined by a flexible channel-defining wall, each of said vibrating units further including an inverted cap that is fittingly mounted in a respective one of said channels, said driving member being mounted in said inverted cap for driving vibration of said inverted cap, said vibrating plate having a cap portion that is inserted fittingly into said inverted cap so as to be vibrated together with said inverted cap upon actuation of said driving member.

2. The furniture as claimed in claim 1, wherein said driving member includes a motor with an output shaft, and a circular driving plate eccentrically connected to said output shaft, each of said vibrating units further including an engaging member that is formed in said inverted cap and that has a curved recessed surface around said driving plate, said recessed surface having two end portions, said driving plate contacting alternately said end portions of said recessed surface when rotated by said output shaft of said motor, thereby enabling swinging of said vibrating plate together with said inverted cap.

3. The furniture as claimed in claim 2, further comprising a cover sheet that is placed on said inflatable body and that covers said vibrating units.

* * * * *